US007380689B2

(12) United States Patent
Parietti

(10) Patent No.: US 7,380,689 B2
(45) Date of Patent: Jun. 3, 2008

(54) BATHROOM TISSUE DISPENSER

(76) Inventor: Michael I. Parietti, 6 Spook Rock Rd., Suffern, NY (US) 10901

( * ) Notice: Subject to any disclaimer, the term of this patent is extended or adjusted under 35 U.S.C. 154(b) by 0 days.

(21) Appl. No.: 11/465,520

(22) Filed: Aug. 18, 2006

(65) Prior Publication Data

US 2008/0078857 A1 Apr. 3, 2008

(51) Int. Cl.
*B65G 59/02* (2006.01)
*B65H 1/04* (2006.01)

(52) U.S. Cl. ..... 221/282; 221/306; 242/598.3; 242/599.3

(58) Field of Classification Search ..... 242/594, 242/594.5, 598.5, 598.3, 599.3; 221/45, 221/47, 48, 63, 199, 282, 283, 286, 306
See application file for complete search history.

(56) References Cited

U.S. PATENT DOCUMENTS

| | | | | |
|---|---|---|---|---|
| 2,790,608 | A | 4/1957 | Sieven | |
| 3,830,198 | A | 8/1974 | Boone | |
| 3,837,595 | A | 9/1974 | Boone | |
| 3,943,859 | A | 3/1976 | Boone | |
| 4,913,312 | A * | 4/1990 | Boutin | 221/45 |
| 5,311,986 | A * | 5/1994 | Putz | 242/598.5 |
| 5,704,565 | A | 1/1998 | Cheng | |
| 5,950,960 | A | 9/1999 | Marino | |
| 6,450,439 | B1 | 9/2002 | van Rees | |
| 6,497,345 | B1 | 12/2002 | Wilker | |
| 6,540,195 | B2 | 4/2003 | Newman | |
| 6,736,287 | B2 * | 5/2004 | Sauer et al. | 221/283 |
| 6,752,294 | B2 | 6/2004 | Osti | |
| 7,040,502 | B2 * | 5/2006 | Phelps et al. | 221/45 |
| 2004/0099680 | A1 * | 5/2004 | Mitchell | 221/45 |
| 2004/0245266 | A1 * | 12/2004 | Mitchell et al. | 221/33 |
| 2004/0245267 | A1 * | 12/2004 | Mitchell et al. | 221/33 |
| 2005/0178781 | A1 * | 8/2005 | Welchel et al. | 221/45 |
| 2006/0138159 | A1 * | 6/2006 | Altuve et al. | 221/45 |
| 2006/0214048 | A1 * | 9/2006 | Sucher | 242/598.5 |
| 2006/0243739 | A1 * | 11/2006 | Sherman et al. | 221/309 |
| 2007/0045334 | A1 * | 3/2007 | Sherman et al. | 221/38 |

* cited by examiner

*Primary Examiner*—William A Rivera
(74) *Attorney, Agent, or Firm*—Michael A. Blake

(57) ABSTRACT

A bathroom tissue dispenser comprising: a bathroom tissue container with a front side, left side, right side, bottom side and a rear side; a mounting device attached to the bathroom tissue container, to facilitate mounting upon a fixed bathroom tissue roll dispenser without requiring any modification to that fixed dispenser; and an opening or a tear away portion located generally on the front side of the bathroom tissue container. This bathroom tissue dispenser can be quickly and easily mounted upon a fixed bathroom tissue dispenser and may replaced with a new one when the bathroom tissue inside is used up. The used dispenser may be discarded or recycled. A bathroom tissue dispenser comprising: a bathroom tissue container with a front side and a rear side; a wall mounting device attached to the bathroom tissue container; and an opening or tear away portion located generally on the front side of the bathroom tissue container. A bathroom tissue dispenser comprising: a bathroom tissue container with a front side, left side, right side, bottom side and a rear side; and a mounting device attached to the bathroom tissue container to facilitate mounting upon a fixed bathroom tissue roll dispenser. All of these bathroom tissue dispensers will most likely, but not necessarily, be prepackaged with bathroom tissue. The bathroom tissue can be a continuous sheet with perforations to facilitate the tearing off of individual sheets, or the bathroom tissue can be individual sheets stacked on top of each other.

16 Claims, 10 Drawing Sheets

BATHROOM TISSUE DISPENSER

TECHNICAL FIELD

This invention relates to a dispenser of tissue paper. More particularly, the present invention relates to a dispenser of bathroom tissue which can be quickly and easily installed in a bathroom.

BACKGROUND

Typically bathroom tissue is dispensed in rolls. Roll dispensers are usually permanently installed in bathrooms using a removeable spindle. In order to replace a bathroom tissue roll, the spindle must be removed from the roll dispenser, the old roll of bathroom tissue removed from the spindle, the new roll of bathroom tissue threaded onto the spindle, and the spindle and bathroom tissue roll reinstalled in the roll dispenser. Many times the roll dispenser is located adjacent to a toilet, or other object, making access to the roll dispenser difficult, thereby making the replacement of tissue rolls in the roll dispenser an arduous task, especially for older users and handicapped users. The width of typical bathroom tissue rolls is unsatisfactory to many people who would prefer wider bathroom tissue which would be easier to use and more effective. The amount of bathroom tissue that can fit on a typical roll is limited and many people would like a bathroom tissue dispenser that can hold a larger quantity of tissue so as to reduce the frequency with which it has to be replaced.

Accordingly, it would be desirable to provide a bathroom tissue dispenser that overcomes the above listed and other disadvantages.

SUMMARY

The disclosed invention relates to a bathroom tissue dispenser comprising: a bathroom tissue container with a front side, left side, right side, bottom side and a rear side; a mounting device that is integral to, or attached to the bathroom tissue container, to facilitate mounting upon a fixed bathroom tissue roll dispenser; and an opening or a tear away portion located generally on the front side of the bathroom tissue container.

The disclosed invention also relates to a bathroom tissue dispenser comprising: a bathroom tissue container with a front side and a rear side; a wall mounting device attached to the bathroom tissue container; and a tear away portion located generally on the front side of the bathroom tissue container.

In addition, the disclosed invention relates to a bathroom tissue dispenser comprising: a bathroom tissue container with a front side, left side, right side, bottom side and a rear side; and a mounting device integral to, or attached to the bathroom tissue container, to facilitate mounting upon a fixed bathroom tissue roll dispenser

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
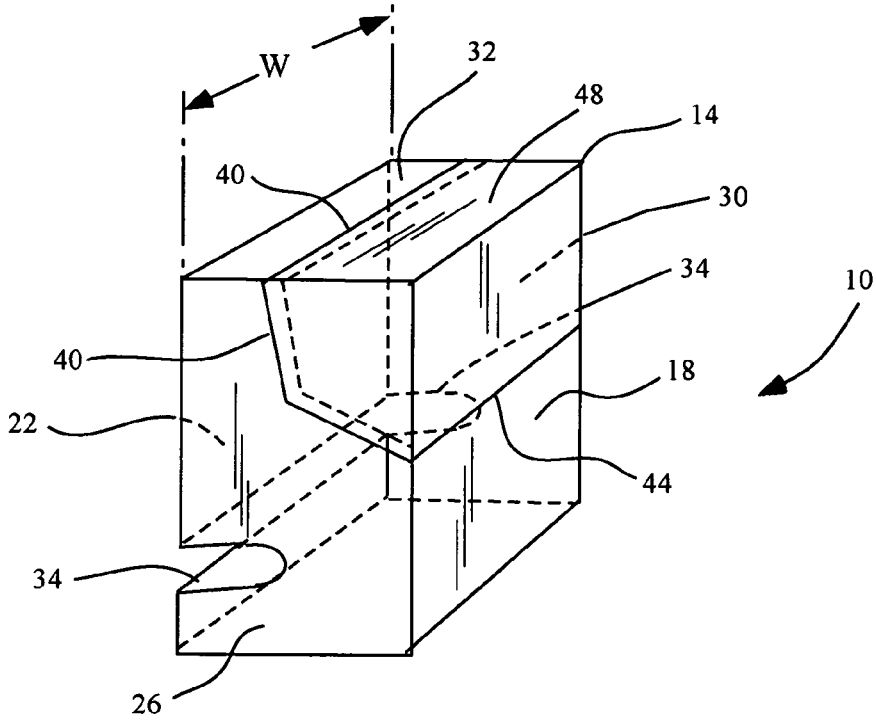
FIG. 1 is a perspective view of an embodiment of the disclosed bathroom tissue dispenser.

FIG. 1 shows a perspective view of one embodiment of the disclosed bathroom tissue dispenser 10. The bathroom tissue dispenser 10 comprises a bathroom tissue container 14. The container 14, in this embodiment, may be shaped generally like a rectangular box. The container may be made out of cardboard, plastic, fiberglass, rubber or any light, easy to produce, and disposable material. The container has front side 18, a rear side 22, a left side 26, a right side 30, and a top side 32. On the rear side of the container 14, a slot 34 is located, the slot 34 extends into the left side 26 and right side 30 of the container 14. The slot 34 extends generally the width "W" of the container. The container may contain perforations 40 on its left side 26, top side 32, and right side 30 (perforations not shown on right side for clarity). The container may be scored on its front side 18, as indicated by the line representing the scoring 44. The scoring 44 is adjacent to the perforations 40 on the left side 26 and right side 30. The perforations 40 and scoring are configured to allow a user to separate the perforated section of the container 14, which will be called the lid 48, and allow the lid to fold at the scoring 44, to allow a user access to the contents of the container 14. In other embodiments, the scoring 44 may be replaced with a perforation, and thereby allow complete removal of the lid 48. In still other embodiments, an opening may be made in the housing rather than having a tear-away lid 48.

Figure 2:
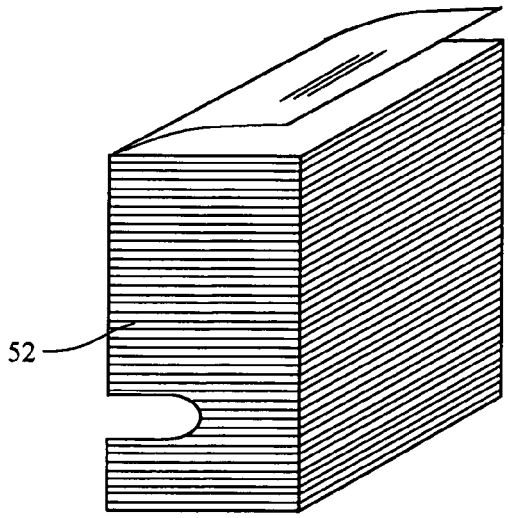
FIG. 2 is a perspective view of bathroom tissue as stored in a disclosed bathroom tissue dispenser.

FIG. 2 shows one embodiment of how bathroom tissue may be arranged when it is in the container 14. The bathroom tissue may be one length of tissue, with perforations at regular intervals, arranged in a stack 52 of tissue folded upon itself.

Figure 3:
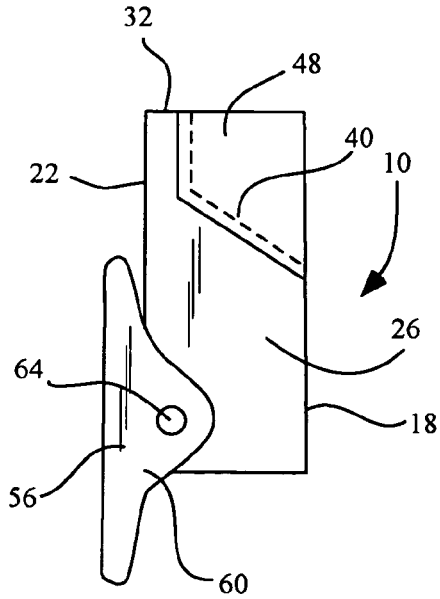
FIG. 3 is a side view of the disclosed bathroom tissue dispenser from FIG. 1 installed on a bathroom tissue roll dispenser.

FIG. 3 shows a side view of the bathroom tissue dispenser 10 installed on a typical bathroom tissue roll dispenser 56 found in many bathrooms. The toilet tissue roll dispenser 56 comprises two spindle holders 60 (only one spindle holder 60 is visible in this view) and one bathroom tissue roll spindle 64. The slot 34 acts as a mounting device to facilitate it's mounting upon the fixed bathroom tissue roll dispenser 56. The slot 34 is configured to fit snugly onto the bathroom tissue roll spindle 64 such that the bathroom tissue dispenser 10 is held in place against the bathroom tissue roll dispenser 56. The bathroom tissue dispenser 10 is configured to slide onto the bathroom tissue roll spindle 64 in a generally lateral fashion. Once installed on a bathroom tissue roll dispenser the user can tear the lid 48 away from the container using the perforations 14, and fold the lid down along the scoring 44, so that the user can access the stack of tissue 52 located in the container 14.

Figure 4:
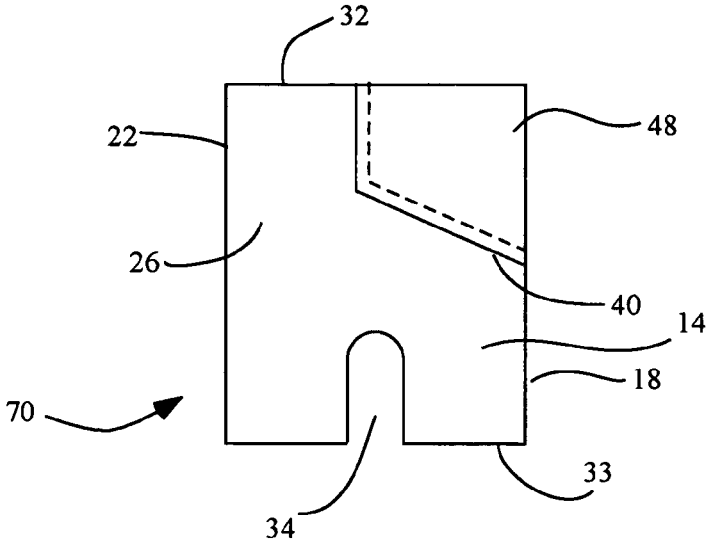
FIG. 4 is a side view of another embodiment of the disclosed bathroom tissue dispenser.
Figure 5:
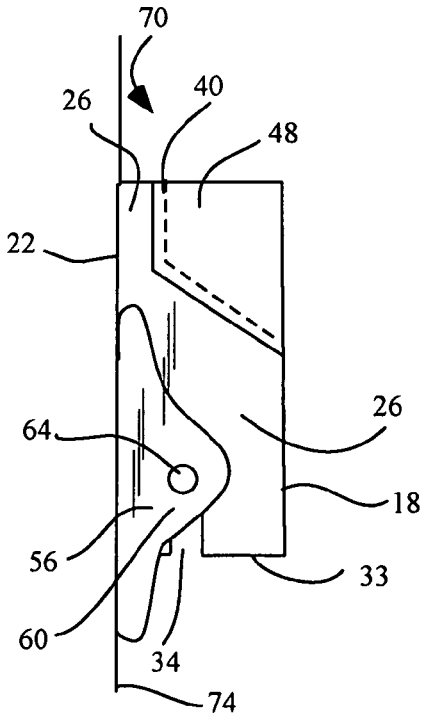
FIG. 5 is a side view of the disclosed bathroom tissue dispenser from FIG. 4, installed on a bathroom tissue roll dispenser.

FIG. 4 shows a side view of another embodiment of a disclosed bathroom tissue dispenser 70. In this embodiment, the container 14 has a front side 18, a rear side 22, left side 26, top side 32, right side 30 (not visible in this view), and a bottom side 33. However, in this embodiment, the slot 34, also known as the mounting device, is located on the bottom side 33 of the container, and extends into the left side 26 and right side 30. Thus, in this embodiment, the bathroom tissue dispenser 10 is configured to slide onto the bathroom tissue roll spindle 64 in a generally vertical fashion. Referring now to FIG. 5, the bathroom tissue dispenser 10 is shown installed on a bathroom tissue roll dispenser 56. The bathroom tissue roll dispenser 56 is installed on a wall 74.

Figure 6:
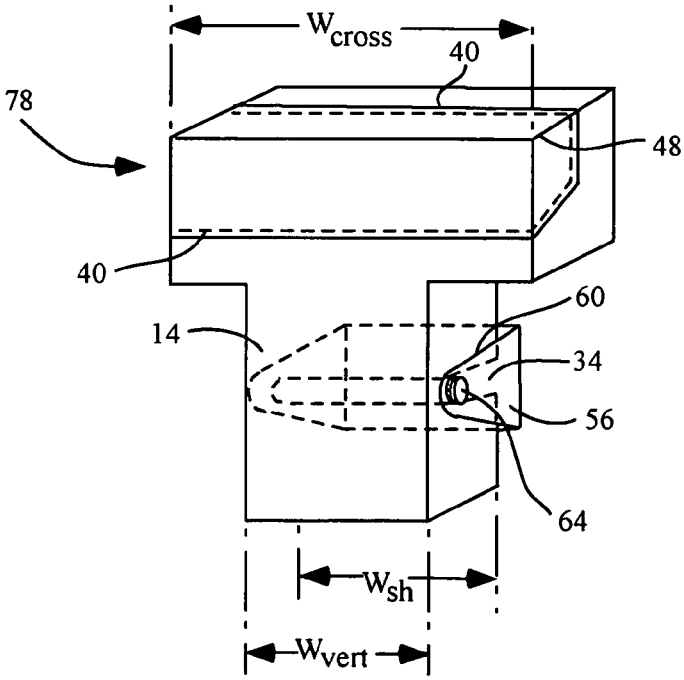
FIG. 6 is a perspective view of another embodiment of the disclosed bathroom tissue dispenser.

FIG. 6 shows another embodiment of a disclosed bathroom tissue dispenser 78. In this embodiment, the shape of the container 14 is a "T-shape" cube. The bathroom tissue roll dispenser 56 is shown in a see-through view so that the slot 34 and bathroom tissue roll dispenser 56 can be seen. Tissue paper will be stored in the container 14. The slot 34 is shown in a lateral configuration, however, the slot may be configured to be a vertical configuration. The cross-member 79 of the T-shaped container 14 has a width $W_{CROSS}$ and the vertical member 80 of the T-shaped container 14 has a width $W_{VERT}$. The bathroom tissue roll dispenser 56 has width between the inner surfaces of the two spindle holders 60 of $W_i$. $W_{CROSS}$ is greater than $W_{VERT}$, and $W_{VERT}$ is less than $W_{SH}$.

Figure 7:
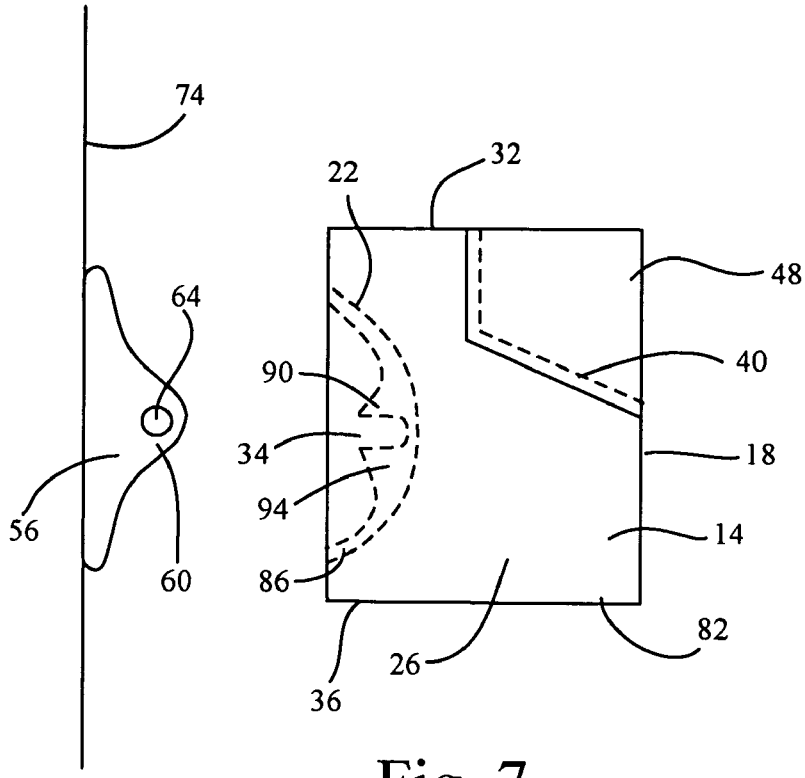
FIG. 7 is a side view of another embodiment of the disclosed bathroom tissue dispenser.
Figure 8:
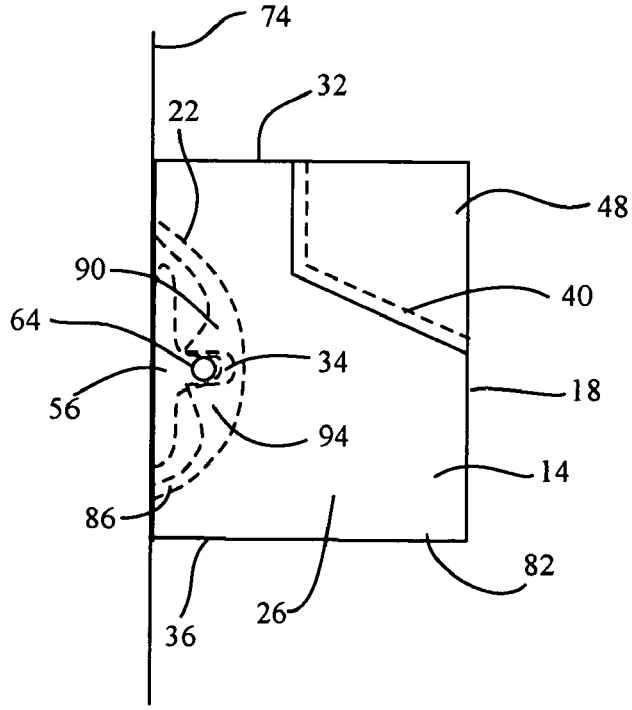
FIG. 8 is a side view of the disclosed bathroom tissue dispenser from FIG. 7 installed on a bathroom tissue roll dispenser.

FIG. 7 shows another embodiment of a disclosed bathroom tissue dispenser 82. The width W of the container 14 is wider than the bathroom tissue roll dispenser 56, such that the right side 30 and left side 26 will fit over the bathroom tissue roll dispenser 56. The rear side 22 of the disclosed bathroom tissue dispenser 82 in this embodiment is generally concave. Attached to this concave shaped rear side 22 is a bathroom tissue roll dispenser mounting device 86. The bathroom tissue roll dispenser mounting device 86 comprises a first lip 90 and a second lip 94. The lips 90, 94 form a slot 34. The slot 34 is configured to fit snuggly onto the bathroom tissue roll spindle 64. FIG. 8 shows the disclosed bathroom tissue dispenser 82 attached to the bathroom tissue roll dispenser 56. The bathroom tissue roll dispenser mounting device 86 may be made out of cardboard, plastic, fiberglass, rubber, a combination of any materials listed, and any other suitable material.

Figure 9:
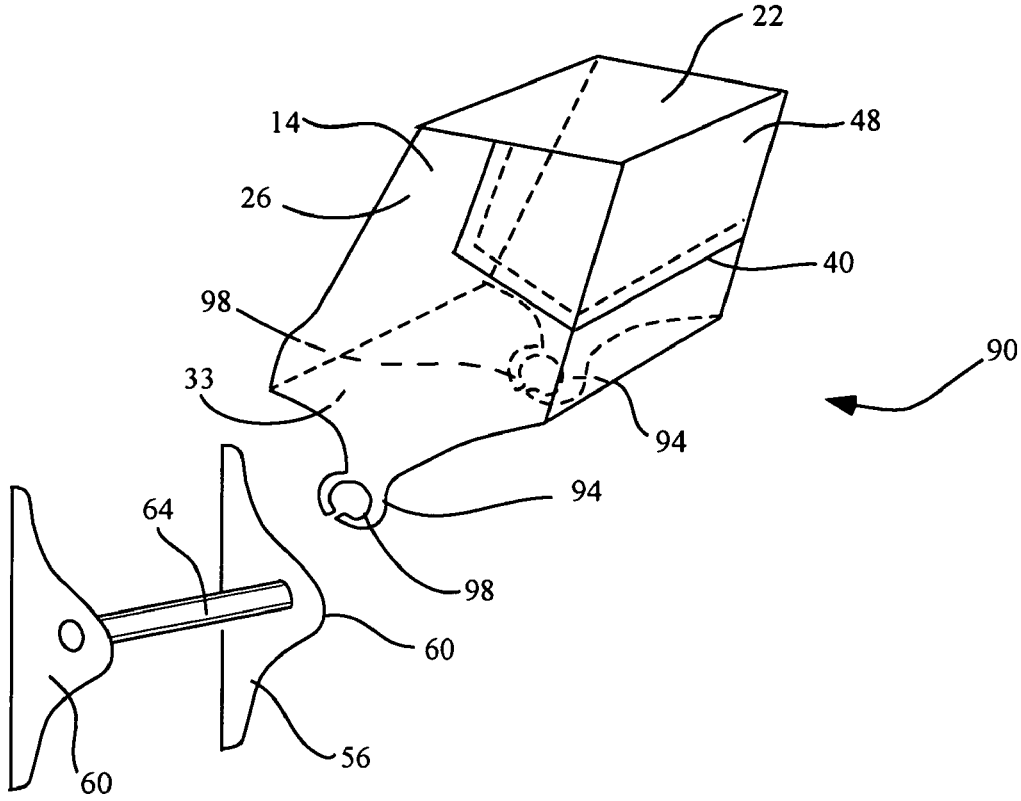
FIG. 9 is a perspective view of another embodiment of the disclosed bathroom tissue dispenser.
Figure 10:
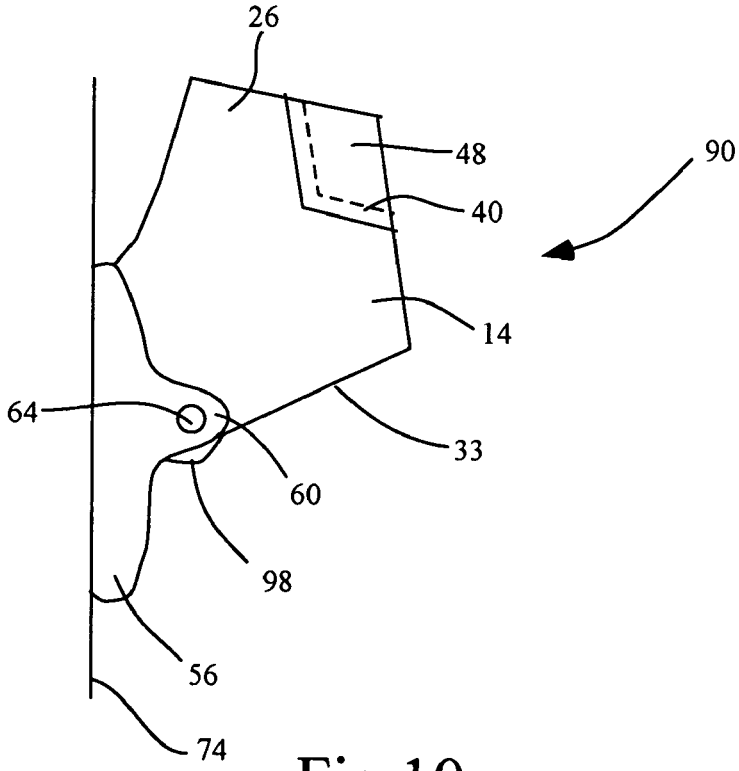
FIG. 10 is a side view of the disclosed bathroom tissue dispenser of FIG. 9 installed on a bathroom tissue roll dispenser.

FIG. 9 shows a perspective view of another embodiment of a disclosed bathroom tissue dispenser 90. In this embodiment, the container 14 has a bathroom tissue roll dispenser mounting device 94 that comprises two spindle grippers 98 located generally on the bottom side 33 of the container 14 near or at the right side 22 and left side 26 of the container 14. The spindle grippers 98 are generally round, and configured to snugly grip a bathroom tissue roll spindle 64. The spindle grippers 98 may be foldable against the bottom 33 of the container for storage. The bathroom tissue roll dispenser mounting device 94 may be made out of cardboard, plastic, fiberglass, rubber, a combination of any materials listed, and any other suitable material. FIG. 10 shows a side view of the another embodiment of a disclosed bathroom tissue dispenser 90 installed on a bathroom tissue roll dispenser 56.

Figure 11:
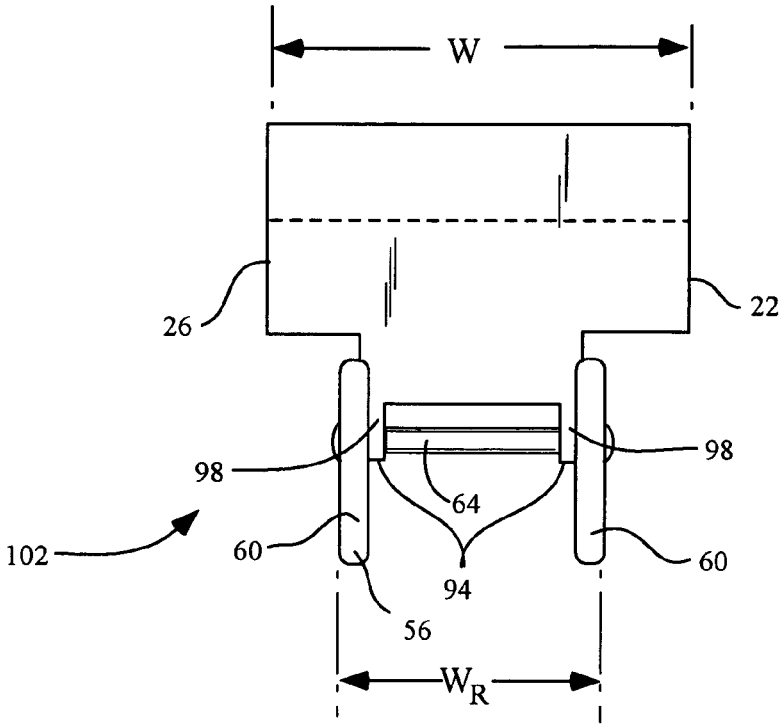
FIG. 11 is a front view of another embodiment of the disclosed bathroom tissue dispenser installed on a bathroom tissue roll dispenser.

FIG. 11 shows another embodiment of a disclosed bathroom tissue dispenser 102. This embodiment is similar to the embodiment shown in FIGS. 9 and 10, except that the spindle grippers 98, that comprise bathroom tissue roll dispenser mounting device 94, are not located at or near the right side 22 and left side 26 of the container 14, but are set in from the right side 22 and left 26 a certain amount, such that the container width W is wider than the width $W_R$ of the bathroom tissue roll dispenser 56.

Figure 12:
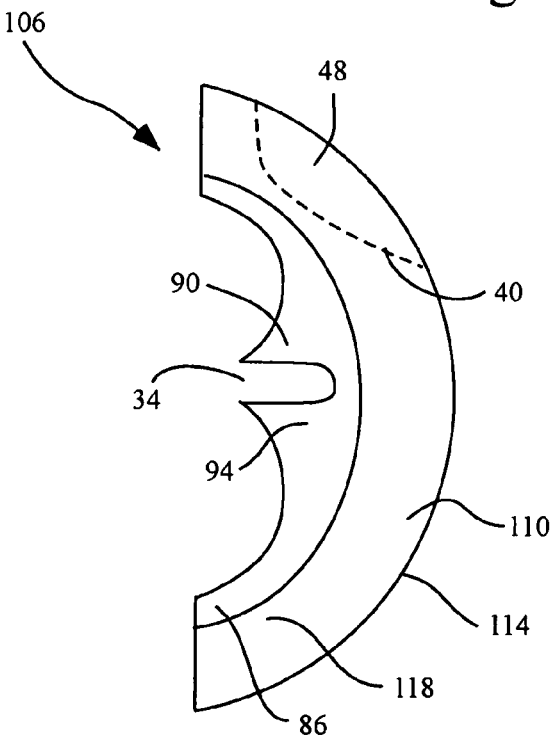
FIG. 12 is a side view of another embodiment of the disclosed bathroom tissue dispenser.
Figure 13:
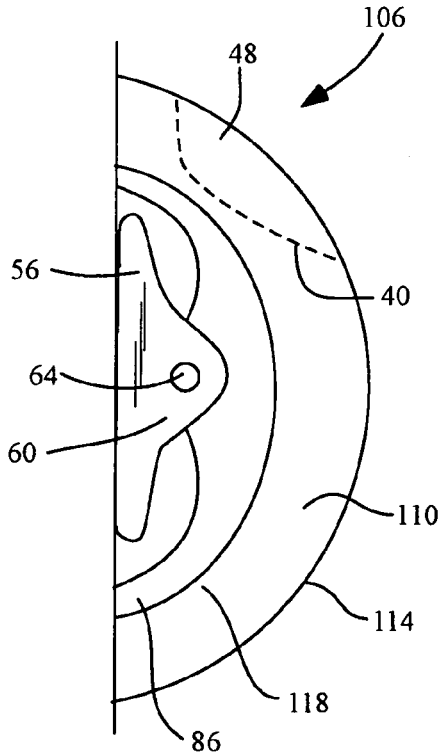
FIG. 13 is a side view of disclosed bathroom tissue dispenser from FIG. 12 installed on a bathroom tissue roll dispenser.
Figure 14:
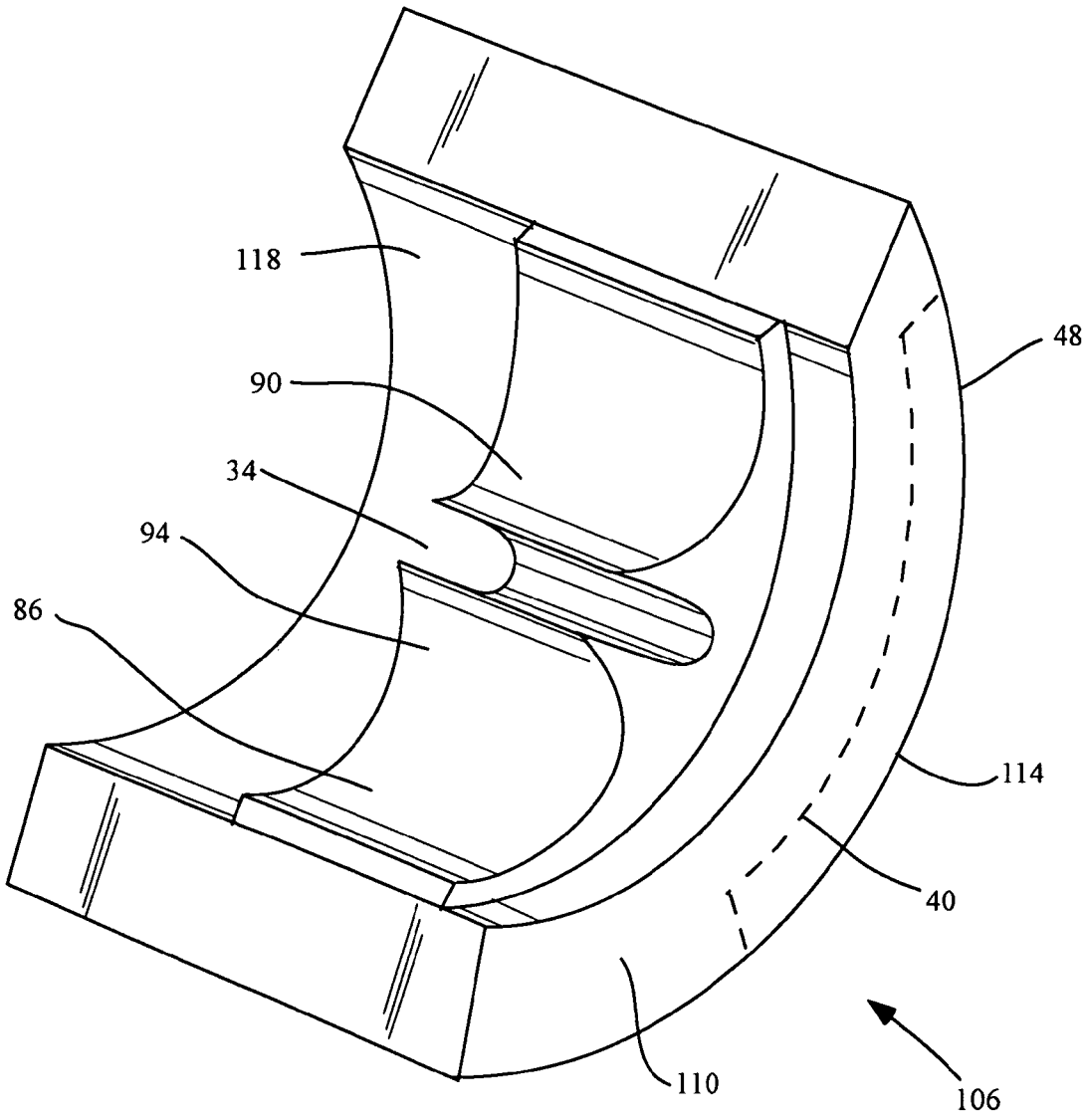
FIG. 14 is a perspective view of disclosed bathroom tissue dispenser from FIG. 12.

FIG. 12 shows a side view of another embodiment of a disclosed bathroom tissue dispenser 106. In this embodiment, the bathroom tissue container 110 has a toroidal shape. The container 110 has a front side 114 and a rear side 118. The rear side 114 of the disclosed bathroom tissue dispenser 106 in this embodiment is generally concave. Attached to this concave shaped rear side 114 is a bathroom tissue roll dispenser mounting device 86. The bathroom tissue roll dispenser mounting device 86 comprises a first lip 90 and a second lip 94. The lips 90, 94 form a slot 34. The slot 34 is configured to fit snuggly onto a bathroom tissue roll spindle 64. The container 110 may have perforations 40 to allow a user to separate the perforated section of the container 110, which will be called the lid 48, to allow a user access to the contents of the container 110. FIG. 13 shows the disclosed bathroom tissue dispenser 106 attached to bathroom tissue roll spindle 64 of a bathroom tissue roll dispenser 56. FIG. 14 shows a perspective view of the disclosed bathroom tissue dispenser 106 from FIG. 12.

Figure 15:
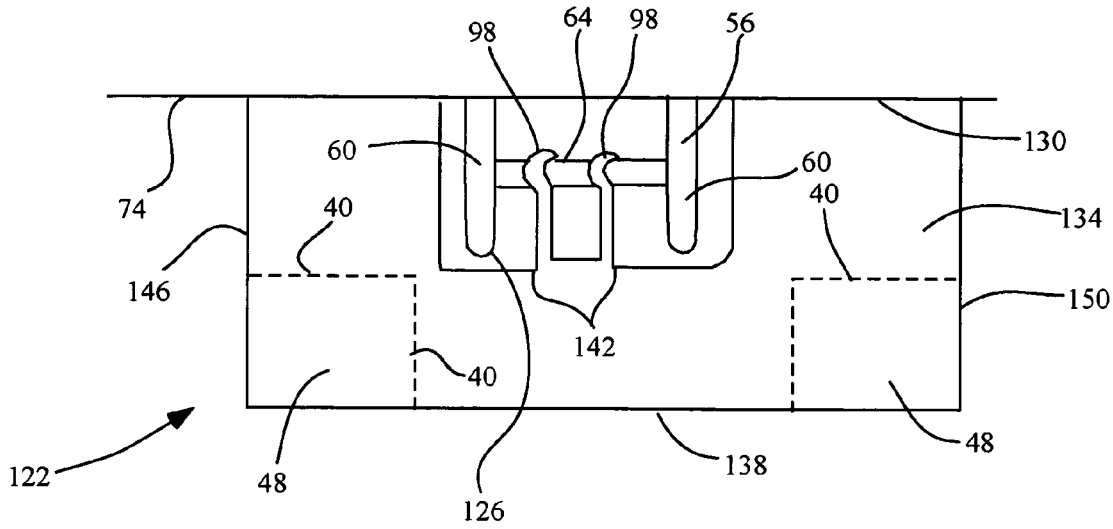
FIG. 15 is a top view of a disclosed bathroom tissue dispenser installed on a bathroom tissue roll dispenser.

FIG. 15 shows a top view of another embodiment of a disclosed bathroom tissue dispenser 122. In this embodiment, the generally cubic rectangular container 14 has a recess 126 on its rear side 130. The top side 134 and front side 138 of the container are located as shown. Extending from a rear wall 142 of the recess 126 is a bathroom tissue roll dispenser mounting device 142. The bathroom tissue roll dispenser mounting device 142 comprises two spindle grippers 98. In this embodiment, top side 134, front side 138, left side 146 and right side 150 of the container 14 have perforations 40 configured to make two lids 48, one adjacent to the left side 146 and one adjacent to the right side 150 of the container. The perforations 40 allow a user to separate one or both of the perforated section of the container 14, the lids 48, to allow a user access to the contents of the container 14.

Figure 16:
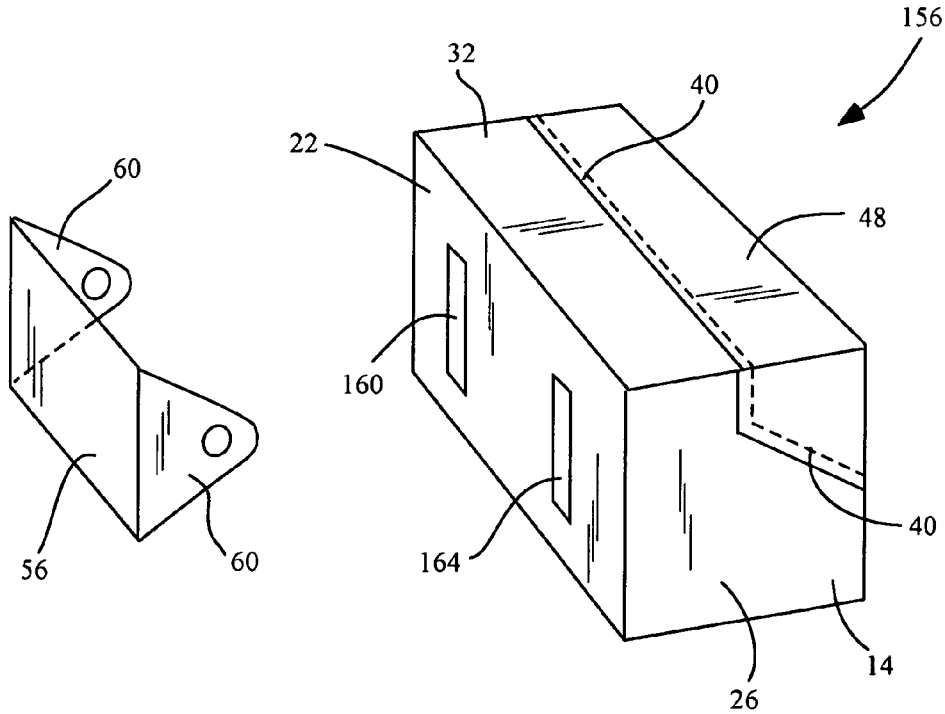
FIG. 16 is a rear perspective view of a two-slotted embodiment of the disclosed bathroom tissue dispenser and bathroom tissue roll dispenser.

FIG. 16 shows a rear perspective view of another embodiment of a disclosed bathroom tissue dispenser 156. In this embodiment, two slots 160, 164 are located on the rear side 22 of the container 14. Each of the slots 160, 164 are configured to snugly fit onto the spindle holders 60 of a bathroom tissue roll dispenser 56. Thus, in this embodiment, the spindle 64 (not shown) is not required for the dispenser 156 to attach to the tissue roll dispenser 56.

Figure 17:
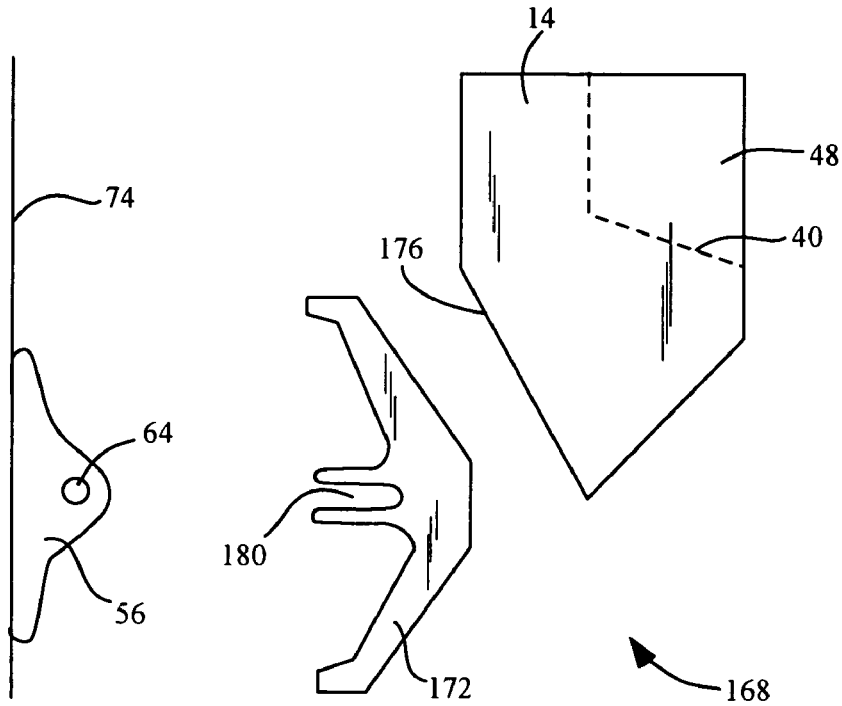
FIG. 17 is a side view of another embodiment of the disclosed bathroom tissue dispenser and a bathroom tissue roll dispenser.
Figure 18:
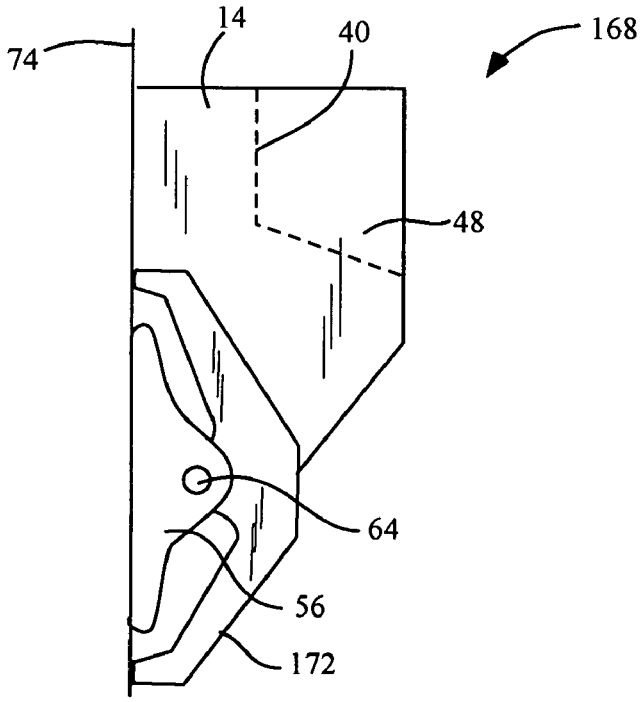
FIG. 18 is a side view of the bathroom tissue dispenser from FIG. 17 shown installed on the bathroom tissue roll dispenser.

FIG. 17 shows a side view of another embodiment of a disclosed bathroom tissue dispenser 168. In this embodiment, the housing 14 is not integral with a bathroom tissue roll dispenser mounting device 172. In this embodiment, the bathroom tissue roll dispenser mounting device 172 is attachable to the housing 14 by the user. A mounting surface 176 on the housing is configured to attach to the a bathroom tissue roll dispenser mounting device 172. An adhesive may be used to attach the mounting surface 176 to the a bathroom tissue roll dispenser mounting device 172. The mounting device has a slot 180 configured to snugly fit onto a bathroom tissue roll spindle 64 of a bathroom tissue roll dispenser 56. FIG. 18 shows a side view of the dispenser 168 attached to a spindle 64 of a bathroom tissue roll dispenser 56.

Figure 19:
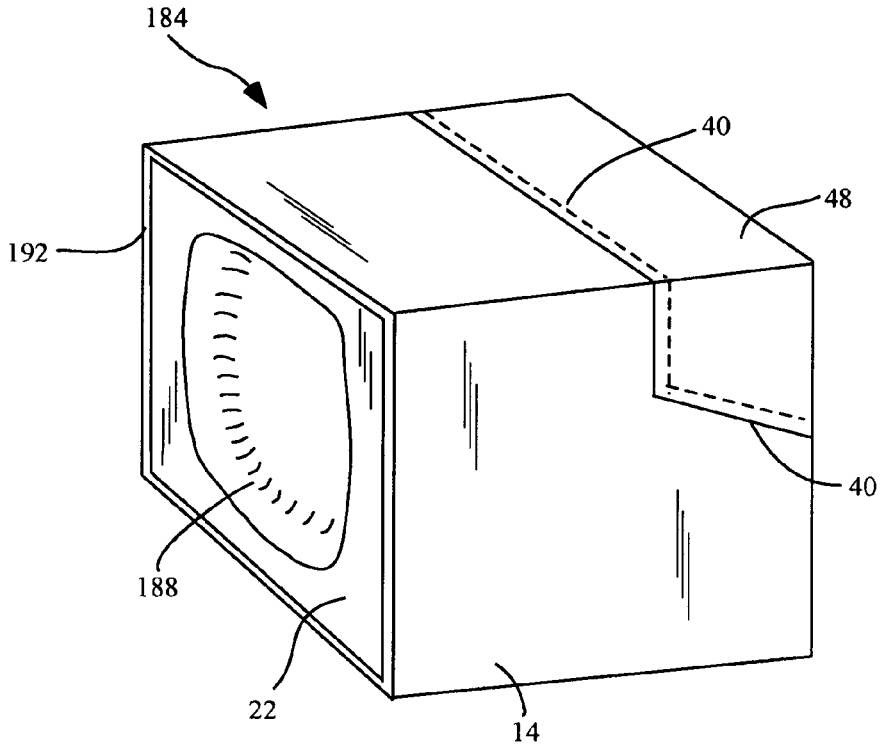
FIG. 19 is a rear perspective view of a recess embodiment of the disclosed bathroom tissue dispenser.

FIG. 19 shows a front view of another embodiment of a disclosed bathroom tissue dispenser 184. In this embodiment, the rear side 22 of the container 14 contains a recess 188. The recess is configured to fit over a number of different styles of bathroom tissue roll dispenser 56. The rear side 22 of the container also has an adhesive band 192 located generally about the periphery of the rear side 22 of the container 14. Thus, the dispenser can be attached to a wall 74, with the recess generally housing the bathroom tissue roll dispenser 56. This embodiment allow the dispenser 184 to attach to a wall 74 over a bathroom tissue roll dispenser 56 with or without using any portion of the fixed toilet tissue dispenser 56 to support itself and supported by adhesive surfaces, or other means of support, that adhere or attach to one, any or all of the wall surfaces, above or below, to the left or right of the of the standard fixed dispenser 56. This embodiment may or may not come into contact with the fixed dispenser. This embodiment could be designed in such a way so as to completely surround the fixed dispenser and hide it from view. It also might adhere, mount or attach to any one or more of the wall surfaces surrounding the dispenser whether it be the surface above and or below, to the left and or the right of the dispenser.

The various disclosed bathroom tissue dispensers discussed up till this point have all used a bathroom tissue roll dispenser mounting device to connect the bathroom tissue dispensers to the already in place bathroom tissue roll dispenser. However, in still another embodiment, the bathroom tissue roll dispenser mounting device may be replaced with a wall mounting device, so that the disclosed bathroom tissue dispenser can attach directly to a wall, without the need for a bathroom tissue roll dispenser being present. The connection means may be a removeable adhesive, which can be removed from the wall after the tissue in the bathroom tissue dispenser has been used up.

Figure 20:
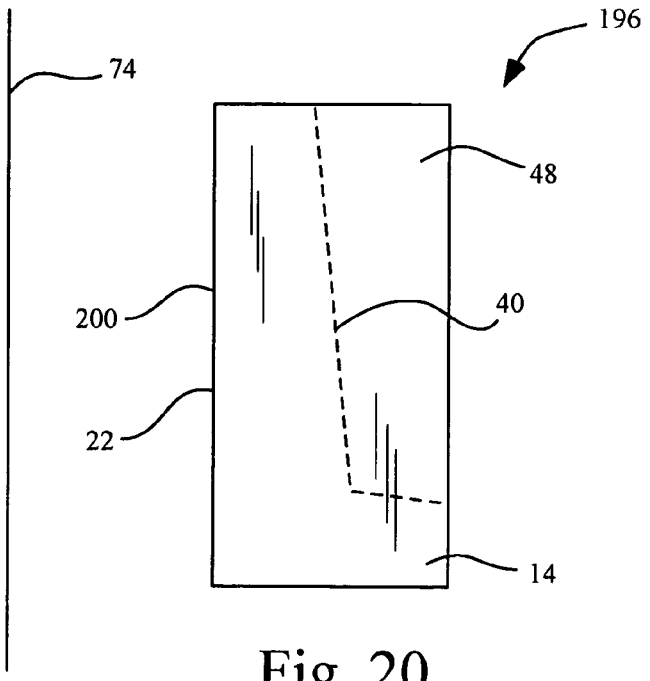
FIG. 20 is a side view of a wall mounted embodiment of the disclosed bathroom tissue dispenser.
Figure 21:
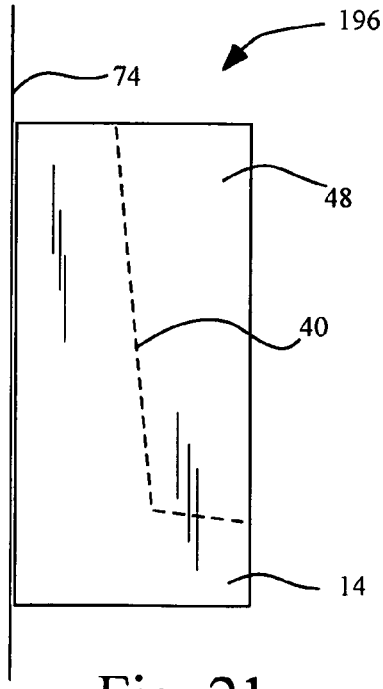
FIG. 21 is a side view of the bathroom tissue dispenser from FIG. 20 shown installed on a wall.
Figure 22:
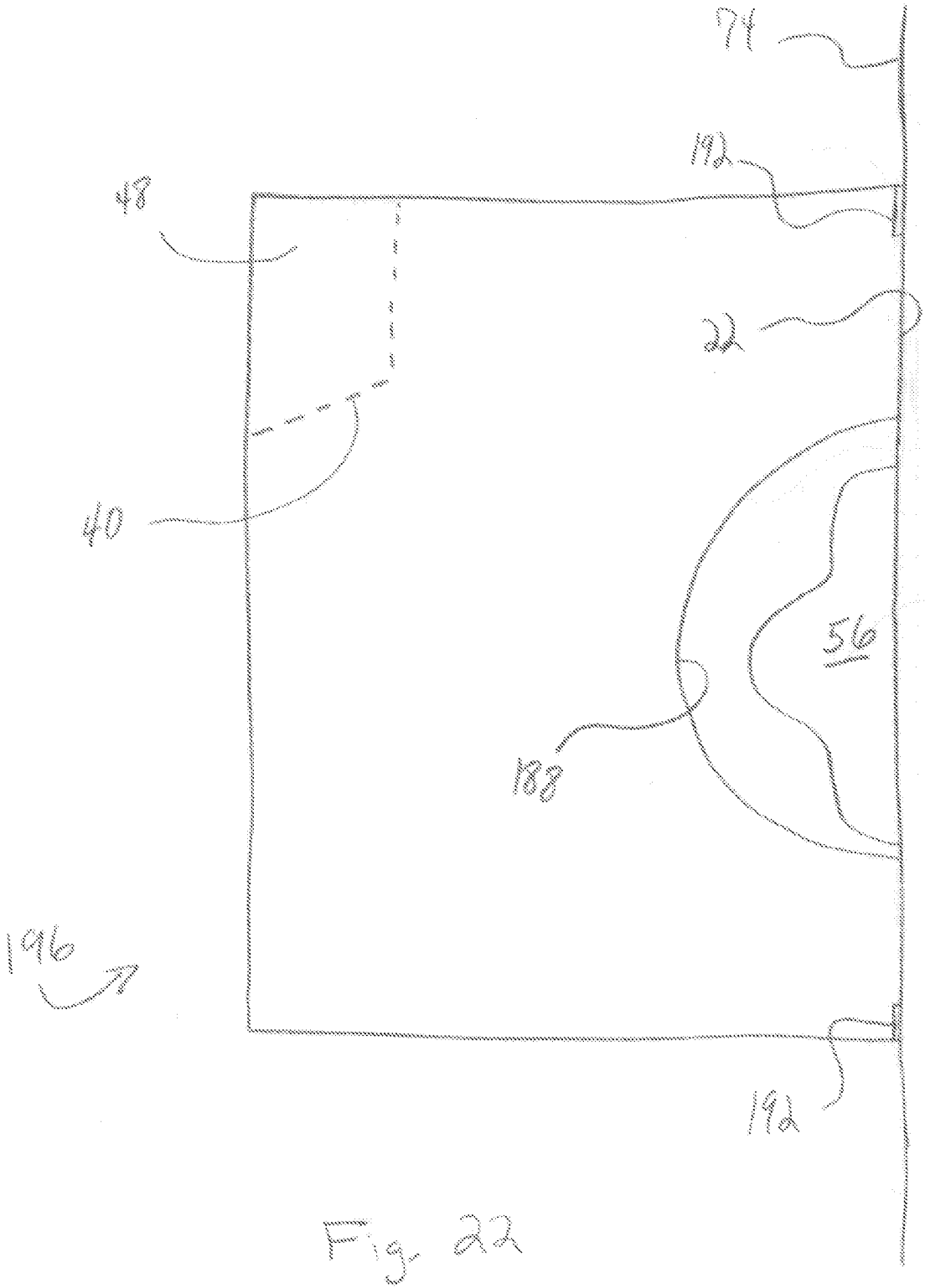
FIG. 22 is a side cross-sectional view of the bathroom tissue dispenser from FIG. 21.

FIG. 20 shows a side view of another embodiment of a disclosed bathroom tissue dispenser 196. The container 14 has a rear side 22. Located on the rear side 22 is an adhesive that is configured to removeably attach to a wall 74. In another embodiment, the adhesive may be configured to permanently attach to a wall 74. With this embodiment, there is no need for a bathroom tissue roll dispenser 56 to be located in a bathroom. Or, if the bathroom tissue roll dispenser 56 is located in a difficult to reach or awkward place, then, the disclosed bathroom tissue dispenser 196 may be placed elsewhere. FIG. 21, shows the bathroom tissue dispenser 196 attached to a wall 74. FIG. 22 is a cross-sectional view of the bathroom tissue dispenser 196 from FIG. 21.

The disclosed bathroom tissue dispenser has man advantages. The user would no longer have to remove the spring loaded spindle, remove it from the cardboard tube of the previous roll, slide it through the cardboard tube of the new roll, and then reinstall the new roll and spring loaded spindle into the fixed dispenser. every time they need to replace the toilet paper. Additionally, since the bathroom tissue dispenser may be wider than the fixed bathroom tissue roll dispenser, the bathroom tissue paper of the disclosed invention may be wider than the standard width bathroom tissue roll and dispenser. In addition, the amount of bathroom tissue paper stored in the disclosed bathroom tissue dispenser can be much greater than the amount stored on a roll, both in terms of width and length. This provides two very important advantages. First, wider bathroom tissue is easier and neater to use than standard width bathroom tissue. Secondly, this invention will have to be replaced less frequently than regular rolls of toilet paper. Another advantage of this invention is that it can be designed in such a way as to make it more aesthetically pleasing to the eye than the standard configuration of a fixed toilet paper dispenser with or without a typical roll of toilet paper. As this invention can cover, mask or hide the fixed dispenser by designing it in an attractive manner one can improve the appearance of their bathroom/toilet area. A further advantage of this invention is that branding, logo and advertising information may be included on the surface of the cardboard packaging which is not possible on standard toilet paper rolls, because companies are reluctant to put such branding info on the actual sheets of toilet paper for obvious reasons. This is a very potent advantage of this invention because people use the bathroom many times each day and will be exposed to this branding info repeatedly through out the day, everyday.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A bathroom tissue dispenser comprising:

a bathroom tissue container with a front side, left side, right side, bottom side and a generally concave rear side;

a mounting device attached to the bathroom tissue container, configured to facilitate mounting of the bathroom tissue dispenser upon a fixed bathroom tissue roll dispenser, the mounting device comprising:

a first lip attached to the rear side of the bathroom tissue container;

a second lip attached to the rear side of the bathroom tissue container;

a slot formed by the first and second lip;

wherein the slot is configured to fit snugly onto a bathroom tissue roll spindle;

a means for accessing bathroom tissue located generally on the front side of the bathroom tissue container.

2. The bathroom tissue dispenser of claim 1, wherein the mounting device may be made out of a material selected from the group consisting of cardboard, plastic, fiberglass, and rubber.

3. The bathroom tissue dispenser of claim 1, where the bathroom tissue dispenser is made out of a material selected from the group consisting of cardboard, plastic, fiberglass, and rubber.

4. The bathroom tissue dispenser of claim 1, wherein the means for accessing bathroom tissue is a tear away portion.

5. The bathroom tissue dispenser of claim 1, wherein the means for accessing bathroom tissue is an opening.

6. The bathroom tissue dispenser of claim 1, wherein the mounting device is removeably attachable to the bathroom tissue container.

7. The bathroom tissue dispenser of claim 1, wherein the mounting device is configured to attach to two adjacent spindle holders of a bathroom tissue roll dispenser.

8. The bathroom tissue dispenser of claim 1, wherein the mounting device comprises:

a slot located on the rear side of the bathroom tissue container; and wherein the slot is configured to fit snugly onto a bathroom tissue roll spindle.

9. The bathroom tissue dispenser of claim 1, wherein the mounting device comprises:

a slot located on the bottom side of the bathroom tissue container; and wherein the slot is configured to fit snugly onto a bathroom tissue roll spindle.

10. The bathroom tissue dispenser of claim 1, wherein the bathroom tissue container comprises:

a cross member, with a width $W_{CROSS}$;

a vertical member, with a width $W_{VERT}$, attached to the cross member;

wherein the $W_{VERT}$ is configured to be less than a width between two surfaces of two adjacent spindle holders of a bathroom tissue roll dispenser, and wherein $W_{CROSS}$ is greater than $W_{VERT}$.

11. A bathroom tissue dispenser comprising:

a bathroom tissue container with a front side and a rear side;

a wall mounting device attached to the bathroom tissue container;

a tear away portion located generally on the front side of the bathroom tissue container;

a generally concave recess located on the rear side of the bathroom tissue container; and wherein the recess is configured to generally enclose a bathroom tissue roll dispenser without contracting the bathroom tissue roll dispenser while allowing the bathroom tissue dispenser to attach flush to a wall.

12. The bathroom tissue dispenser of claim 11, wherein the means for accessing bathroom tissue is a tear away portion.

13. The bathroom tissue dispenser of claim 11, wherein the means for accessing bathroom tissue is an opening.

14. The bathroom tissue dispenser of claim 11, wherein the bathroom tissue container comprises:

a cross member, with a width WCROSS;

a vertical member, with a width WVERT, attached to the cross member;

wherein the WVERT is configured to be less than a width between two surfaces of two adjacent spindle holders of a bathroom tissue roll dispenser, and wherein WCROSS is greater than WVERT.

15. The bathroom tissue dispenser of claim 11, wherein the mounting device may be made out of a material selected from the group consisting of cardboard, plastic, fiberglass, and rubber.

16. The bathroom tissue dispenser of claim 11, where the bathroom tissue dispenser is made out of a material selected from the group consisting of cardboard, plastic, fiberglass, and rubber.

* * * * *